US012534840B2

(12) United States Patent
Chung et al.

(10) Patent No.: US 12,534,840 B2
(45) Date of Patent: Jan. 27, 2026

(54) UNLOCKING LAUNDRY APPLIANCES WITH ACOUSTIC WAVES

(71) Applicant: Haier US Appliance Solutions, Inc., Wilmington, DE (US)

(72) Inventors: MyungGeon Chung, Seoul (KR); Wonmyung Seo, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 377 days.

(21) Appl. No.: 18/097,839

(22) Filed: Jan. 17, 2023

(65) Prior Publication Data

US 2024/0240383 A1 Jul. 18, 2024

(51) Int. Cl.

| | |
|---|---|
| ***D06F 33/50*** | (2020.01) |
| ***D06F 34/05*** | (2020.01) |
| *D06F 105/44* | (2020.01) |
| *D06F 105/60* | (2020.01) |

(52) U.S. Cl.

CPC ..... *D06F 33/50* (2020.02); *D06F 34/05* (2020.02); *D06F 2105/44* (2020.02); *D06F 2105/60* (2020.02)

(58) Field of Classification Search

CPC ..... D06F 33/50; D06F 34/04; D06F 34/05; D06F 2105/60; D06F 2103/40

See application file for complete search history.

(56) References Cited

U.S. PATENT DOCUMENTS

| | | | |
|---|---|---|---|
| 10,325,269 | B2 | 6/2019 | Kwon et al. |
| 10,711,382 | B2 | 7/2020 | Takanashi |
| 10,887,447 | B2 | 1/2021 | Jakobsson et al. |
| 2020/0362497 | A1 | 11/2020 | Park et al. |

FOREIGN PATENT DOCUMENTS

| | | | | |
|---|---|---|---|---|
| EP | 3705617 | A1 * | 9/2020 | ..... D06F 25/00 |
| KR | 20200022405 | A | 3/2020 | |
| WO | WO2001011575 | A1 * | 2/2001 | |

* cited by examiner

*Primary Examiner* — Michael E Barr
*Assistant Examiner* — Kevin G Lee
(74) *Attorney, Agent, or Firm* — Dority & Manning, P.A.

(57) ABSTRACT

A method of operating a laundry appliance may include a step locking the laundry appliance. The method also may include a step of projecting acoustic waves. The acoustic waves may be modulated to carry an indicium of the laundry appliance. The acoustic waves may be projected by the laundry appliance. The method may also include a step of receiving the acoustic waves by a remote user interface device. The method may further include creating a session of the laundry appliance. The method may additionally include activating the laundry appliance after creating the session of the laundry appliance.

17 Claims, 8 Drawing Sheets

UNLOCKING LAUNDRY APPLIANCES WITH ACOUSTIC WAVES

FIELD OF THE INVENTION

The present subject matter relates generally to laundry appliances, and more particularly to methods of unlocking laundry appliances.

BACKGROUND

Laundry appliances generally include washing machine appliances and dryer appliances. Some laundry appliances, such as commercial laundry appliances, may be required to be unlocked by, e.g., a user, prior to use. For example, such laundry appliances may be found in a laundromat, dormitory, or apartment building, etc. Conventionally, commercial laundry appliances may include an identifying marker such as a barcode printed on the laundry appliance that may be used to unlock the laundry appliance prior to use.

In some instances, the printed identifying marker may be unrecognizable, e.g., it may be partially erased or completely erased. In other instances, the identifying marker may be defunct due to the identifying information of the laundry appliance being changed or updated. As such, it may be desirable to unlock the laundry appliance to create a user specific session without the need of an identifying marker that is printed on the laundry appliance.

Accordingly, improved, e.g., more reliable and updatable, methods for unlocking and/or operating laundry appliances are desired in the art.

BRIEF DESCRIPTION

Aspects and advantages of the invention will be set forth in part in the following description, or may be obvious from the description, or may be learned through practice of the invention.

In accordance with one exemplary aspect of the present disclosure, a method of operating a laundry appliance is provided. The method includes locking the laundry appliance. In addition, the method includes projecting, by the laundry appliance, acoustic waves. The acoustic waves may be modulated to carry an indicium of the laundry appliance. The method also includes receiving the projected acoustic waves. The projected acoustic waves may be received by a remote user interface device. The method further includes creating a session of the laundry appliance. In addition, the method includes activating the laundry appliance after creating the session of the laundry appliance.

In accordance with another exemplary aspect of the present disclosure, a method of operating a laundry appliance is provided. The method includes transmitting acoustic waves. The acoustic waves may be modulated to carry an indicium of the laundry appliance. The method also includes demodulating the acoustic waves to extract the indicium of the laundry appliance. The acoustic waves may be demodulated by a remote user interface device. The method further includes creating a session of the laundry appliance. In addition, the method includes activating the laundry appliance after creating the session of the laundry appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
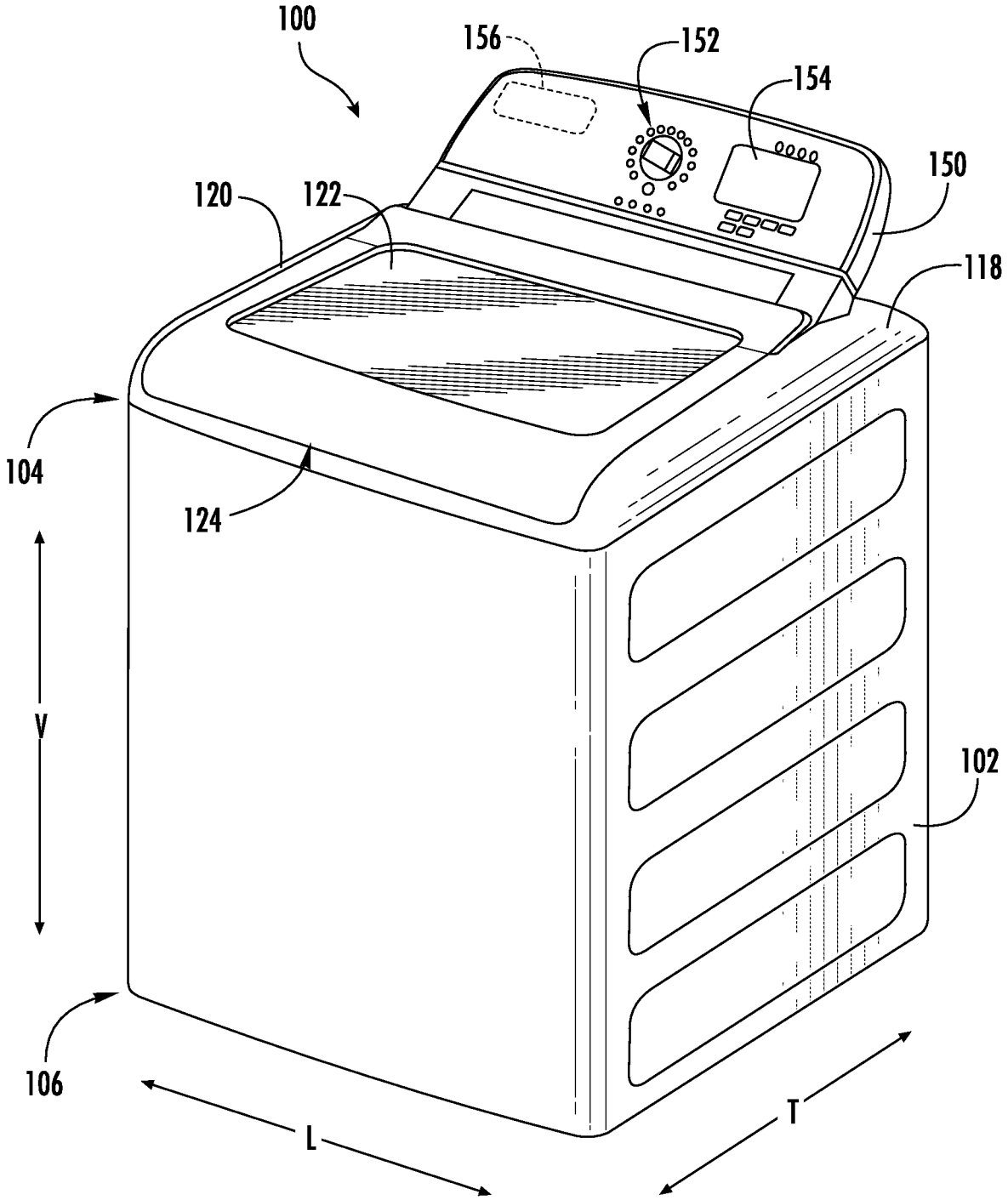
FIG. 1 provides a perspective view of a laundry appliance according to an exemplary embodiment of the present subject matter with a door of the laundry appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of two or more of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," and "about," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, reference to "an embodiment" or "one embodiment" does not necessarily refer to the same embodiment, although it may. Any implementation described herein as "exemplary" or "an embodiment" is not necessarily to be construed as preferred or advantageous over other implementations.

Figure 2:
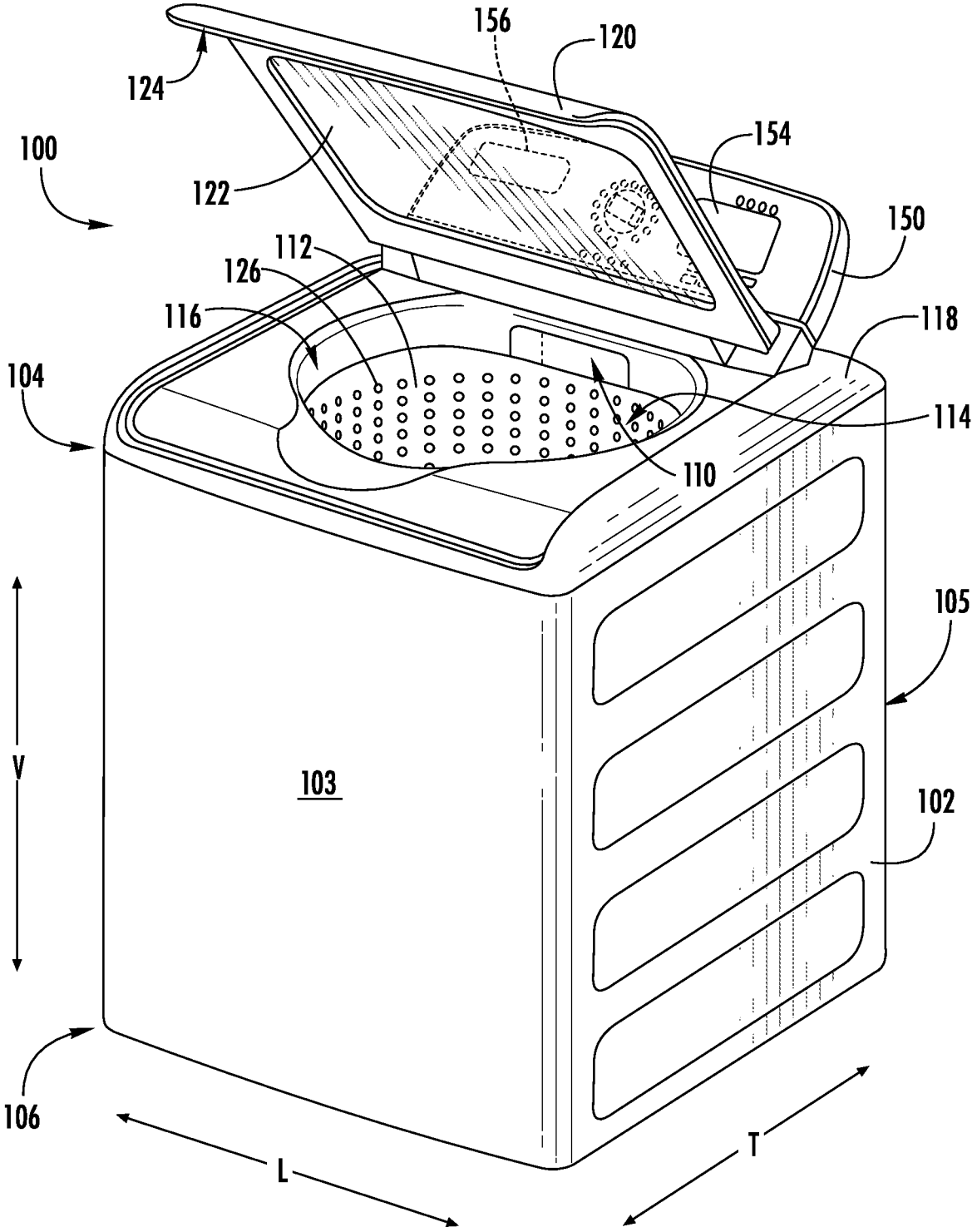
FIG. 2 provides a perspective view of the laundry appliance of FIG. 1 with the door of the exemplary laundry appliance shown in an open position.
Figure 3:
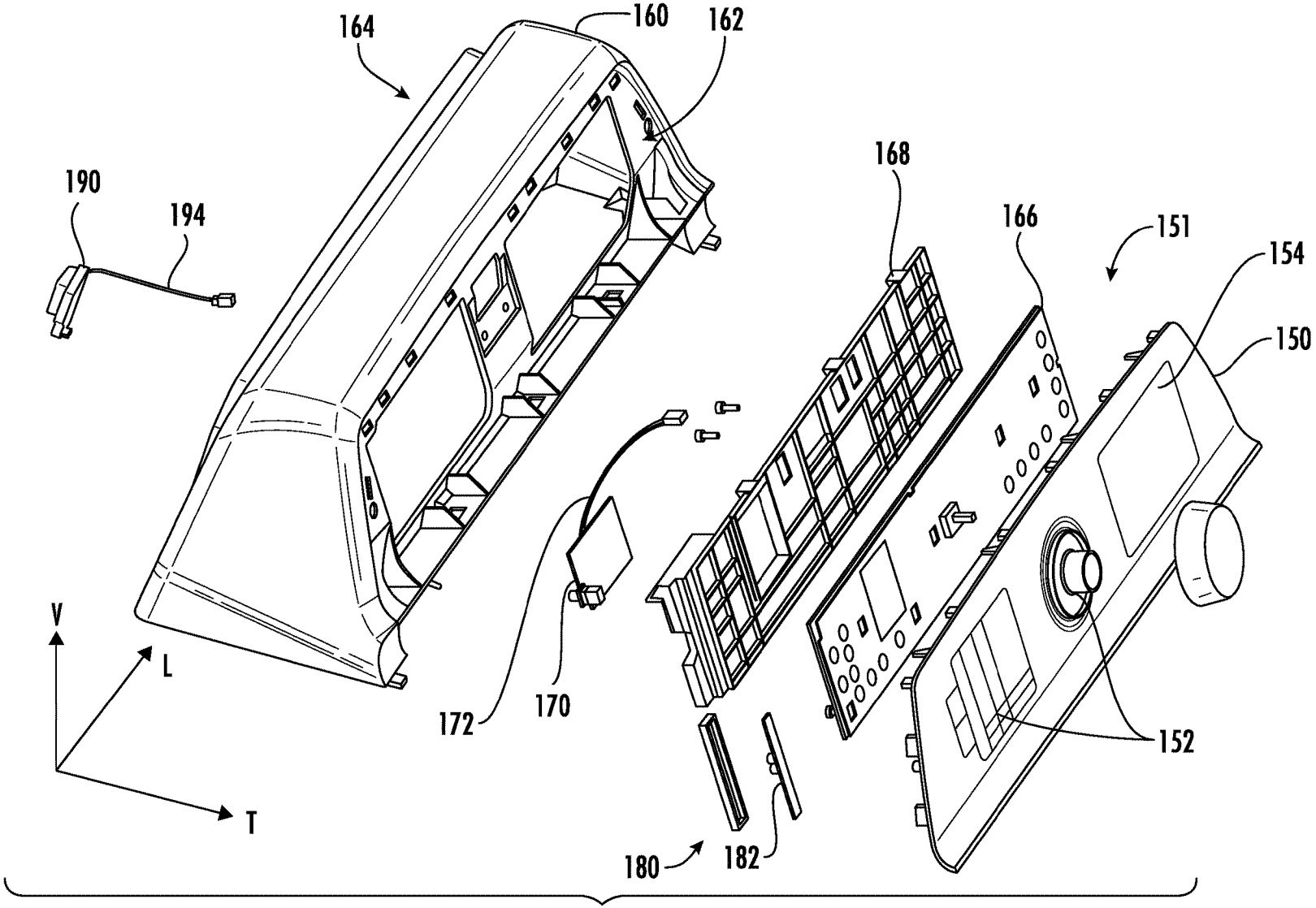
FIG. 3 provides an exploded view of a user interface of the laundry appliance of FIG. 1.

FIGS. 1 and 2 illustrate an exemplary embodiment of a vertical axis washing machine appliance 100. Specifically, FIGS. 1 and 2 illustrate perspective views of washing machine appliance 100 with a door thereof in a closed and an open position, respectively. Washing machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis washing machine, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter. Additionally, or alternatively, it will be understood that aspects of the present disclosure may be used in other laundry appliances, such as a dryer appliance. Accordingly, hereinafter, washing machine appliance 100 may be referred to simply as laundry appliance 100.

Laundry appliance 100 may have a cabinet 102 that extends between a top portion 104 and a bottom portion 106 along the vertical direction V and between a front panel 103 and a back panel 105 along the transverse direction T. A tub (e.g., wash tub) may be positioned within cabinet 102 and is generally configured for retaining wash fluids during an operating cycle. Laundry appliance 100 may further include a primary dispenser 110 (FIG. 2) for dispensing wash fluid the tub. The term "wash fluid" refers to a liquid used for washing and/or rinsing articles during an operating cycle and may include any combination of water, detergent, fabric softener, bleach, and other wash additives or treatments.

In addition, laundry appliance 100 may include a wash basket 112 that is positioned within the tub and generally defines a wash chamber 114 including an opening 116 for receipt of articles for washing. More specifically, wash basket 112 may be rotatably mounted within the tub such that it is rotatable about an axis of rotation. According to the illustrated embodiment, the axis of rotation is substantially parallel to the vertical direction V. In this regard, appliance 100 may be generally referred to as a "vertical axis" or "top load" washing machine appliance 100. However, as noted above, it should be appreciated that aspects of the present subject matter may be used within the context of a horizontal axis or front load washing machine appliance, as well as other laundry appliances.

As illustrated, cabinet 102 of laundry appliance 100 may have a top panel 118. Top panel 118 may define an opening (FIG. 2) that coincides with opening 116 of wash basket 112 to permit a user access to wash basket 112. Appliance 100 may further include a door 120 which is rotatably mounted to top panel 118 to permit selective access to opening 116. In particular, door 120 selectively rotates between the closed position (as shown in FIG. 1) and the open position (as shown in FIG. 2). In the closed position, door 120 inhibits access to wash basket 112. Conversely, in the open position, a user may access wash basket 112. A window 122 in door 120 permits viewing of wash basket 112 when door 120 is in the closed position, e.g., during operation of appliance 100. Door 120 may also include a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIG. 2, wash basket 112 may further define a plurality of perforations 126 to facilitate fluid communication between an interior of wash basket 112 and the tub. In this regard, wash basket 112 is spaced apart from the tub to define a space for wash fluid to escape wash chamber 114. During a spin cycle, wash fluid within articles of clothing and within wash chamber 114 is urged through perforations 126 wherein it may collect in a sump defined by the tub. Laundry appliance 100 may further include a drain pump assembly that is located beneath the tub and wash basket 112 for gravity assisted flow when draining the tub, e.g., after a wash or rinse cycle.

An impeller or agitator, such as a vane agitator, impeller, auger, oscillatory basket mechanism, or some combination thereof may be disposed in wash basket 112 to impart an oscillatory motion to articles and liquid in wash basket 112. More specifically, the agitator may extend into wash basket and assist agitation of articles disposed within wash basket 112 during operation of laundry appliance 100, e.g., to facilitate improved cleaning. In different embodiments, the agitator may include a single action element (i.e., oscillatory only), a double action element (oscillatory movement at one end, single direction rotation at the other end) or a triple action element (oscillatory movement plus single direction rotation at one end, single direction rotation at the other end). Additionally, or alternatively, the agitator may be omitted entirely according to certain embodiments.

Operation of laundry appliance 100 may be controlled by a controller 156, e.g., a processing device, which is communicatively coupled with a control panel 150 (described in further detail below) for user manipulation to select washing machine cycles and features, for example. Controller 156 may operate the various components of laundry appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of appliance 100 may be in communication with controller 156 via one or more signal lines or shared communication buses.

Referring to FIGS. 1 through 7, a user interface assembly including control panel 150 will be described in detail. For instance, control panel 150 may include at least one input selector 152 (FIG. 1). Control panel 150 and input selector 152 may collectively form a user interface 151 for operator selection of machine cycles and features. A display 154 of control panel 150 indicates selected features, operation mode, a countdown timer, and/or other items of interest to appliance users regarding operation of the laundry appliance.

An interface housing 160 may be attached to cabinet 102. In detail, interface housing 160 may extend from cabinet 102 (e.g., generally along the vertical direction V) at a rear portion of cabinet 102. Control panel 150 may be attached to interface housing 160. For instance, interface housing 160 may include a front face 162 (e.g., facing toward front panel 103 of laundry appliance 100) and a rear face 164 (e.g., opposite front face 162 and facing toward back panel 105 of washing machine appliance 100). Control panel 150 may be attached to front face 162 of interface housing 160. Front face 162 may form one or more struts to which control panel 150 is coupled (e.g., via one or more fasteners, adhesives, magnets, snaps, clips, or the like). According to some embodiments, control panel 150 forms front face 162 of interface housing 160. In other words, control panel 150 may be integrally formed with interface housing 160.

User interface 151 may include an interface printed circuit board (PCB) 166. Interface PCB 166 may be accommodated within interface housing 160. For instance, interface housing 160 may form a receiving zone or receiving space (e.g., between front face 162 and rear face 164) in which one or more components may be positioned. Interface PCB 166 may be operably connected with control panel 150 (e.g., and input selectors 152). Additionally, or alternatively, interface PCB 166 may be operably connected with controller 156. According to some embodiments, interface PCB 166 operates as control panel 150. Thus, interface PCB 166 may include a plurality of electrical elements such as light emitting diodes (LEDs), touch buttons, electrical receptors, and the like. Interface PCB 166 may be connected to a fascia (e.g., control panel 150) as well as interface housing 160. For example, interface PCB 166 is attached to each of control panel 150 and interface housing 160 via a mechanical connection (e.g., fasteners, heat stakes, snaps, adhesives, magnets, clips, or the like).

A voice module 170 may be accommodated within interface housing 160. In detail, voice module 170 may be a voice module PCB operably connected with interface PCB 166. Voice module PCB 170 and interface PCB 166 may be connected, for example, via a board-to-board harness 172. Accordingly, signals (e.g., electrical signals) may be exchanged between interface PCB 166 and voice module PCB 170. In detail, inputs (e.g., commands, voice inputs, queries, etc., explained in more detail below) to voice module 170 may be transferred to interface PCB 166. Accordingly, analysis performed by voice module 170 may be presented to control panel 150 via interface PCB upon receiving information signals from voice module 170.

Voice module 170 may include artificial intelligence (AI) software components (e.g., voice assistant modules) providing voice activated assistance to users. For instance, voice module 170 may include network connected algorithms capable of communicating with multiple other networks connected appliances within a household or other group of appliances, such as one or more additional laundry appliances. Accordingly, voice module 170 may include software programs implemented by a controller (e.g., controller 156). Additionally, or alternatively, voice module 170 may be connected through the Internet to retrieve and present information and/or multimedia (e.g., music, video, etc.). Voice module 170 may utilize artificial intelligence, neural networks, machine learning, or deep learning algorithms that are speaker dependent. Accordingly, voice module 170 may be trained to recognize a keyword and initiate activation and interaction upon recognizing the keyword.

Laundry appliance 100 may include an interface board bracket 168. Interface board bracket 168 may be accommodated within interface housing 160. For instance, interface board bracket 168 may be provided behind interface PCB 166 (e.g., within interface housing 160). Interface board bracket 168 may be selectively coupled with one or more of interface housing 160 (e.g., front face 162 or rear face 164), control panel 150, voice module 170, or additional modules or PCBs (described below). Interface board bracket 168 may include or be provided as a plastic piece injection molded to accept connection pieces associated with the interface housing 160, control panel 150, voice module 170, etc. For instance, a plurality of complementary voids (e.g., snap hooks, threaded apertures, flexible tabs, etc.) may be formed in interface board bracket 168. Each of interface housing 160, control panel 150, voice module 170, etc. may be fixed to one or more of the complementary voids. Accordingly, interface board bracket 168 may provide a strategic arrangement and organization of each piece of equipment accommodated within interface housing 160.

Figure 5:
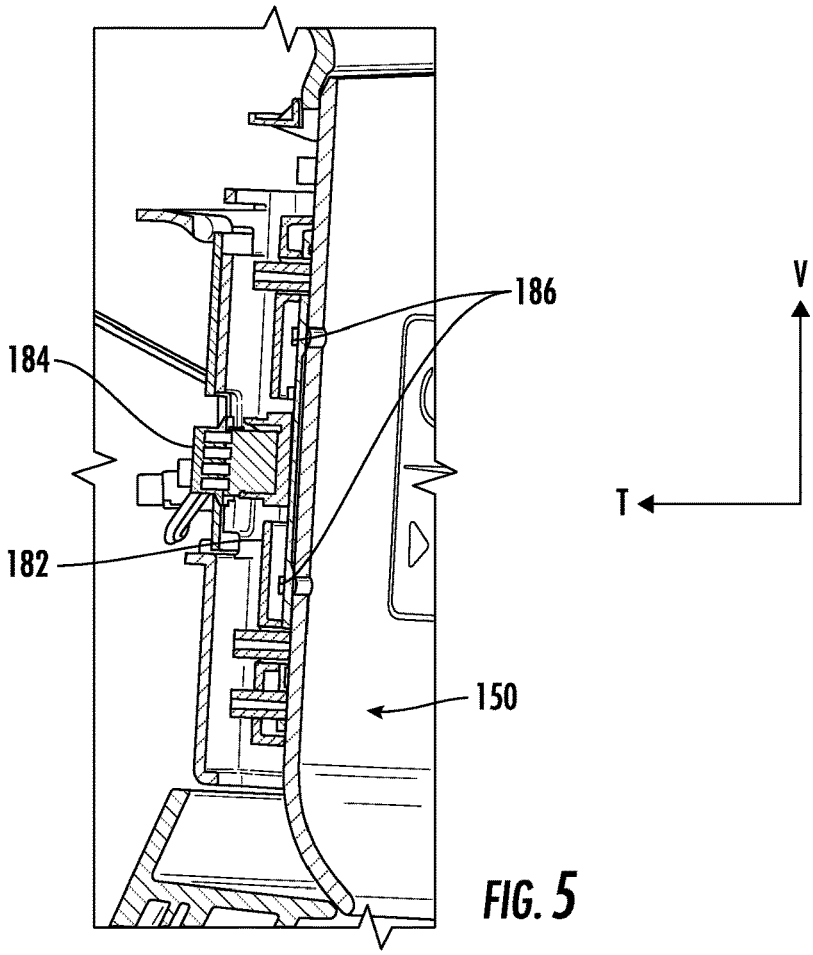
FIG. 5 provides a side cut-away view of the exemplary user interface of FIG. 3.

Laundry appliance 100 may include a microphone assembly 180 accommodated within interface housing 160. In detail, microphone assembly 180 may include a microphone PCB 182. Microphone PCB 182 may be provided separately from voice module PCB 170. For instance, microphone PCB 182 may be a separate PCB from voice module 170. Accordingly, microphone PCB 182 may be positioned at one or more of a plurality of locations within interface housing 160 (e.g., spaced apart from voice module 170). Additionally, or alternatively, microphone PCB 182 may be positioned outside of interface housing 160. Microphone PCB 182 may be electrically connected with voice module PCB 170 via a board-to-board harness 184 (FIG. 5). Accordingly, signals (e.g., electronic signals) may be exchanged between microphone PCB 182 and voice module 170.

Microphone PCB 182 may be attached to interface PCB 166. Additionally, or alternatively, microphone PCB 182 may be attached to control panel 150. For instance, microphone PCB 182 may be attached to a rear face of control panel 150 (e.g., within interface housing 160). Microphone PCB 182 may be attached via any suitable method (e.g., fasteners, snaps, adhesives, clips, magnets, heat stakes, etc.). According to some embodiments, microphone PCB 182 is attached to front face 162 of interface housing 160 (e.g., proximate control panel 150). It should be noted that microphone PCB 182 may be positioned at any suitable location on or in laundry appliance 100 (e.g., within interface housing 160).

Microphone PCB 182 may include a plurality of microphone receivers 186 attached thereto. For at least one example, two microphone receivers 186 are provided. For the sake of brevity, a single microphone receiver 186 will be described herein with the understanding that the description is applicable to each microphone receiver 186. Microphone receiver 186 may be used for monitoring the sound waves, noises, or other vibrations generated by a user near laundry appliance 100. For example, microphone receiver 186 may be one or more microphones, acoustic detection devices, vibration sensors, or any other suitable acoustic transducers that are positioned at one or more locations in or around appliance 100. For example, according to exemplary embodiments, microphone receiver 186 may be mounted within interface housing 166 for detecting any sounds within audible range of appliance 100. Additionally, or alternatively, microphone receiver 186 may be positioned elsewhere within appliance 100. In this regard, any suitable microphone receiver 186 that is acoustically or electrically coupled with appliance 100 (e.g., voice module 170) may be used to monitor sounds. Microphone receiver 186 may be communicatively coupled to (i.e., in operative communication with) controller 156.

Figure 4:
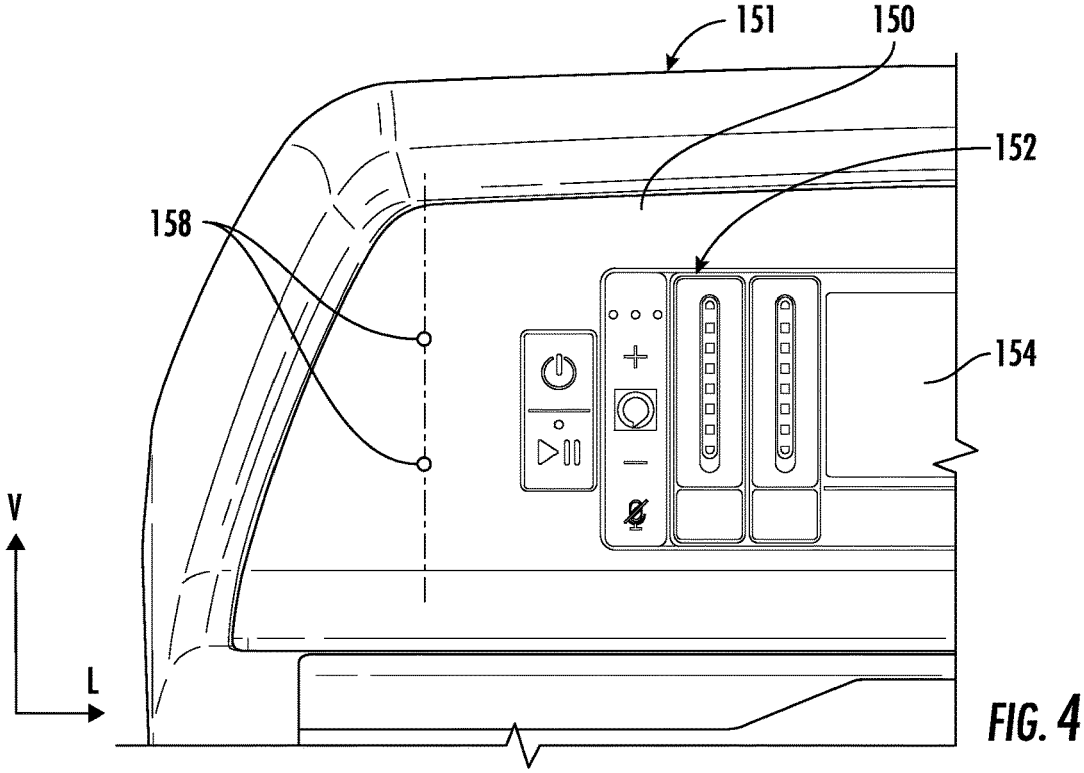
FIG. 4 provides a close-up front view of the exemplary user interface of FIG. 3.

Moreover, user interface 151 (e.g., control panel 150) may include a plurality of microphone holes 158 formed therein, e.g., as illustrated in FIG. 4. For instance, the number of microphone holes 158 may correspond to the number of microphone receivers 186 provided on microphone PCB 182. For instance, if two microphone receivers 186 are provided on microphone PCB 182, two microphone holes 158 are formed in user interface 151. Accordingly, microphone receivers 186 may be positioned proximate microphone holes 158 (e.g., facing outward from interface housing 166). According to at least some embodiments, the plurality of microphone holes 158 are positioned at a lateral side of user interface 151 (e.g., a lateral side of appliance 100 or interface housing 166). Advantageously, the plurality of microphone holes 158 may not interfere with input selectors 152, display 154, or any other features on control panel 150, providing a seamless and efficient organization and presentation of control panel 150.

Microphone receivers 186 may be spaced apart from each other on microphone PCB 182. In detail, microphone receivers 186 may be spaced apart from each other along the vertical direction V. As shown in FIG. 4, microphone receivers 186 (and the corresponding microphone holes 158) may be orientated along the vertical direction V within interface housing 166 (and on control panel 150). Accordingly, microphone receivers 186 may form a vertical array. Accordingly, microphone PCB 182 (and microphone receivers 186) may be easily and conveniently positioned within interface housing 166 and presented on control panel 150. It should be noted that any suitable number of microphone receivers 186 may be provided on microphone PCB 182, and the disclosure is not limited to the examples given herein. Additionally, or alternatively, multiple microphone PCBs 182 may be provided at different locations within interface housing 160 and with different alignments and/or offsets from each other.

Figure 6:
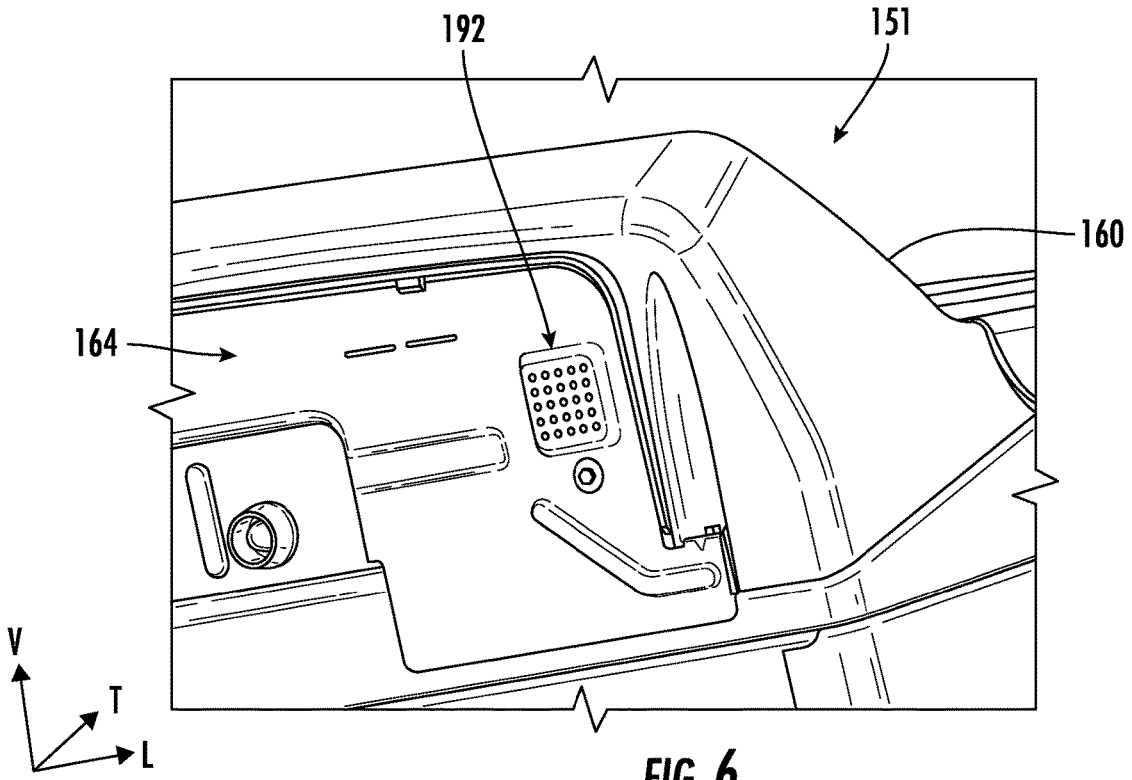
FIG. 6 provides a rear perspective view of the exemplary user interface of FIG. 3.
Figure 7:
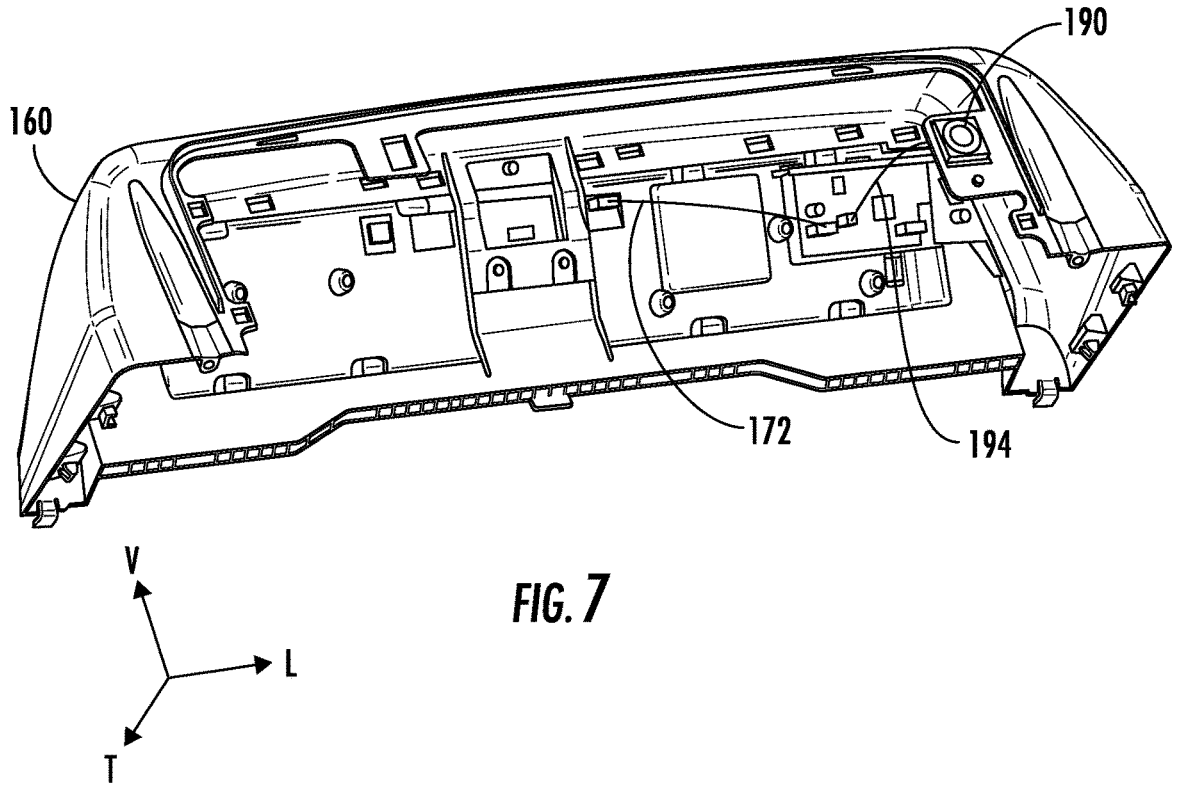
FIG. 7 provides a rear perspective view of an interior of the exemplary user interface of FIG. 3.

As may be seen, e.g., in FIGS. 6 and 7, laundry appliance 100 may include a speaker 190. Speaker 190 may be provided within interface housing 160. For instance, speaker 190 may be provided at or near a rear (e.g., rear face 164) of interface housing 160. According to some embodiments, speaker 190 is attached to an interior surface of rear face 164 of interface housing 160. Speaker 190 may be attached to rear face 164 via any suitable manner (e.g., fasteners, snaps, adhesives, clips, magnets, heat stakes, etc.). Accordingly, as will be described in greater detail below, speaker 190 may project acoustic waves (e.g., sound waves) out from the rear of interface housing 160. In additional embodiments, the speaker 190 may also or instead be positioned and configures to project acoustic waves out from one or more other sides of the interface housing 160, such as the top, front, left, and/or right sides of the interface housing 160.

Speaker 190 may be any suitable speaker or transducer capable of emitting audio signals. As described above, speaker 190 may be associated with smart software to provide information and assistance to users via audio prompts (e.g., via voice module 170). Speaker 190 may also output various alerts, tones, and/or other audio signals. For instance, speaker 190 may play tones to indicate a cycle end time, a fault of the appliance, a timer conclusion or warning, or the like. Speaker 190 may be fully integrated with control panel 150. Additionally, as will be explained in more detail below, speaker 190 may also output acoustic waves that have been modulated to carry data, such as an indicium of the laundry appliance.

Rear face 164 of interface housing 160 may include a speaker outlet 192. For instance, speaker outlet 192 may be formed as an opening (e.g., aperture) in rear face 164. According to some embodiments, speaker outlet 192 is formed as a plurality of apertures allowing fluid communication between the interior of interface housing 160 and an ambient atmosphere. Speaker 190 may be positioned proximate speaker outlet 192. For example, speaker 190 is located adjacent to speaker outlet 192. Moreover, an outlet direction of speaker 190 may be directed at speaker outlet 192. Advantageously, the sound output from speaker 190 may be directed outward from interface housing, such as through the speaker outlet 192.

Speaker 190 may be operably coupled with voice module 170. For instance, speaker 190 may be electrically connected to voice module 170 via a board-to-board harness 194. Accordingly, signals (e.g., electronic signals) may be exchanged between speaker 190 and voice module 170. Additionally, or alternatively, speaker 190 may be operably connected with controller 156. For instance, one or more additional connectors may be provided to connect speaker 190 with controller 156. Accordingly, signals (e.g., electronic signals) may be exchanged between controller 156 and speaker 190. In detail, standard (e.g., non-artificial intelligence related) signals or audio outputs may be provided to speaker 190 from controller 156 (e.g., without having to pass through voice module 170).

Figure 8:
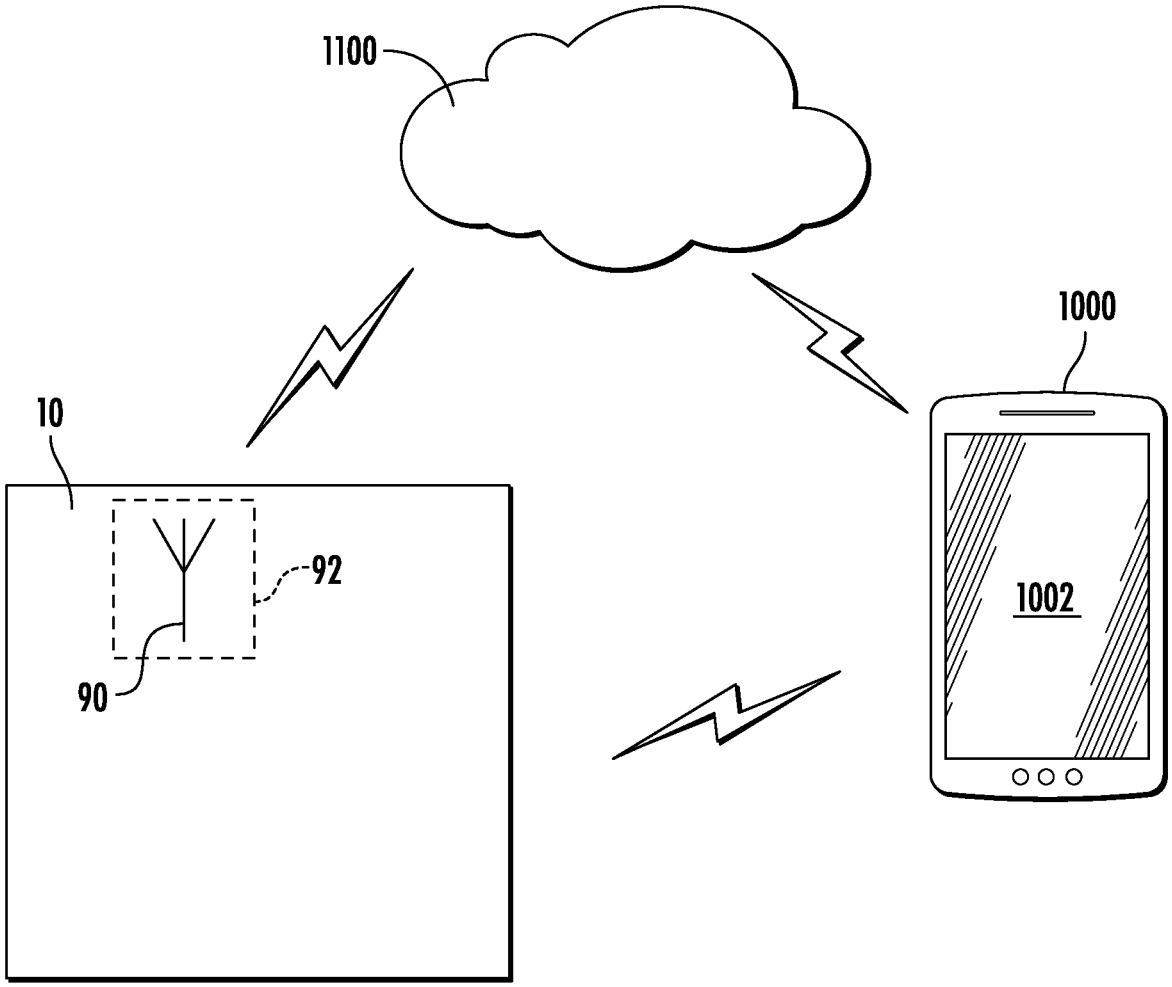
FIG. 8 provides a diagrammatic illustration of a laundry appliance in communication with a remote computing device and with a remote user interface device according to one or more exemplary embodiments of the present subject matter.

Turning now to FIG. 8, a general schematic is provided of a laundry appliance 10, such as but not limited to laundry appliance 100 described above, which communicates wirelessly with a remote user interface device 1000 and a network 1100. For example, as illustrated in FIG. 8, the laundry appliance 10 may include an antenna 90 by which the laundry appliance 10 communicates with, e.g., sends and receives signals to and from, the remote user interface device 1000 and/or network 1100. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart speaker, smart home system, and/or various other suitable devices. The communications module 92 may be onboard the controller 156 or may be a separate module.

The laundry appliance 10 may be in communication with the remote user interface device 1000 device through various possible communication connections and interfaces. The laundry appliance 10 and the remote user interface device 1000 may be matched in wireless communication, e.g., connected to the same wireless network. The laundry appliance 10 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the laundry appliance 10 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not structurally connected to the laundry appliance 10, e.g., the remote user interface device 1000 is a separate, stand-alone device from the laundry appliance 10 which communicates with the laundry appliance 10 wirelessly. Any suitable device separate from the laundry appliance 10 that is configured to provide and/or receive communications, information, data, or commands from a user may serve as the remote user interface device 1000, such as a smartphone (e.g., as illustrated in FIG. 8), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface 151. For example, the remote user interface device 1000 may be a smartphone operable to store and run applications, also known as "apps," and the additional user interface may be provided as a smartphone app.

As mentioned above, the laundry appliance 10 may also be configured to communicate wirelessly with a network 1100. The network 1100 may be, e.g., a cloud-based data storage system including one or more remote computing devices such as remote databases and/or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, and/or edge computing. For example, the laundry appliance 10 may communicate with the network 1100 over the Internet, which the laundry appliance 10 may access via WI-FI®, such as from a WI-FI® access point in a user's home, or in a laundromat or dormitory, etc.

As briefly mentioned above, the remote user interface device may be configured to receive acoustic waves that have been modulated to carry an indicium of the laundry appliance. It should be appreciated that the indicum may include identifying information of the laundry appliance and may be used to pair the laundry appliance with the remote user interface device. For example, the indicium may include a serial number, a MAC ID, or any other suitable identifying information of the laundry appliance.

Moreover, in some embodiments the acoustic waves may be projected by the laundry appliance, e.g., by the speaker 190 of the laundry appliance. For example, the remote user interface device 1000 may be a smartphone, e.g., as illustrated in FIG. 8, which includes a microphone (not shown) for receiving the acoustic waves projected by the laundry appliance. The acoustic waves projected by the laundry appliance may be received by or with the remote user interface device 1000, e.g., using the microphone thereof. Upon receiving the acoustic waves, the remote user interface device may demodulate the acoustic waves to extract the indicium carried by the acoustic wave. As will be appreciated, this extracted indicium may be used to create a session of the laundry appliance by pairing the laundry appliance and the remote user interface device, e.g., whereby the laundry appliance may be controlled by or from the remote user interface device, e.g., the laundry appliance may receive and respond to commands from the remote user interface device when paired.

Figure 9:
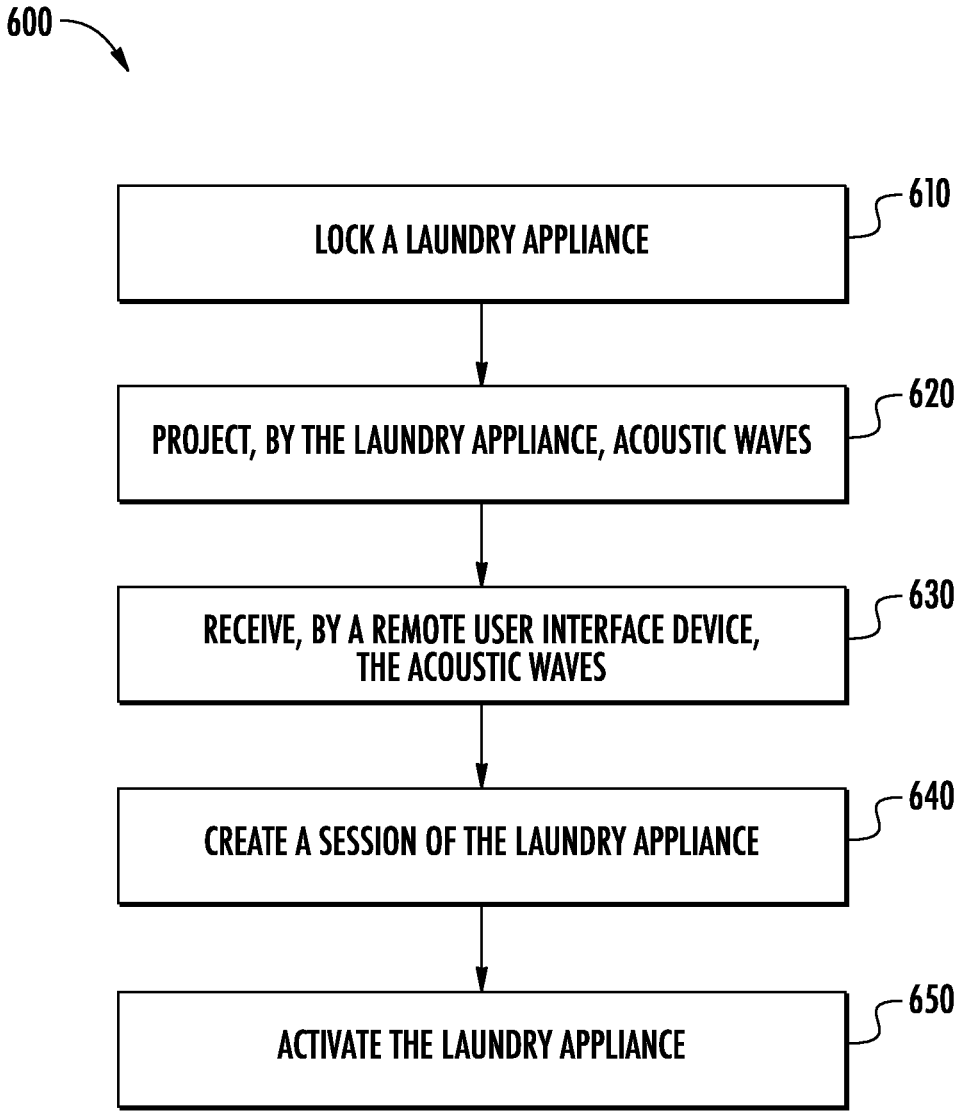
FIG. 9 provides a flowchart illustrating an example method of operating a laundry appliance according to one or more embodiments of the present disclosure.
Figure 10:
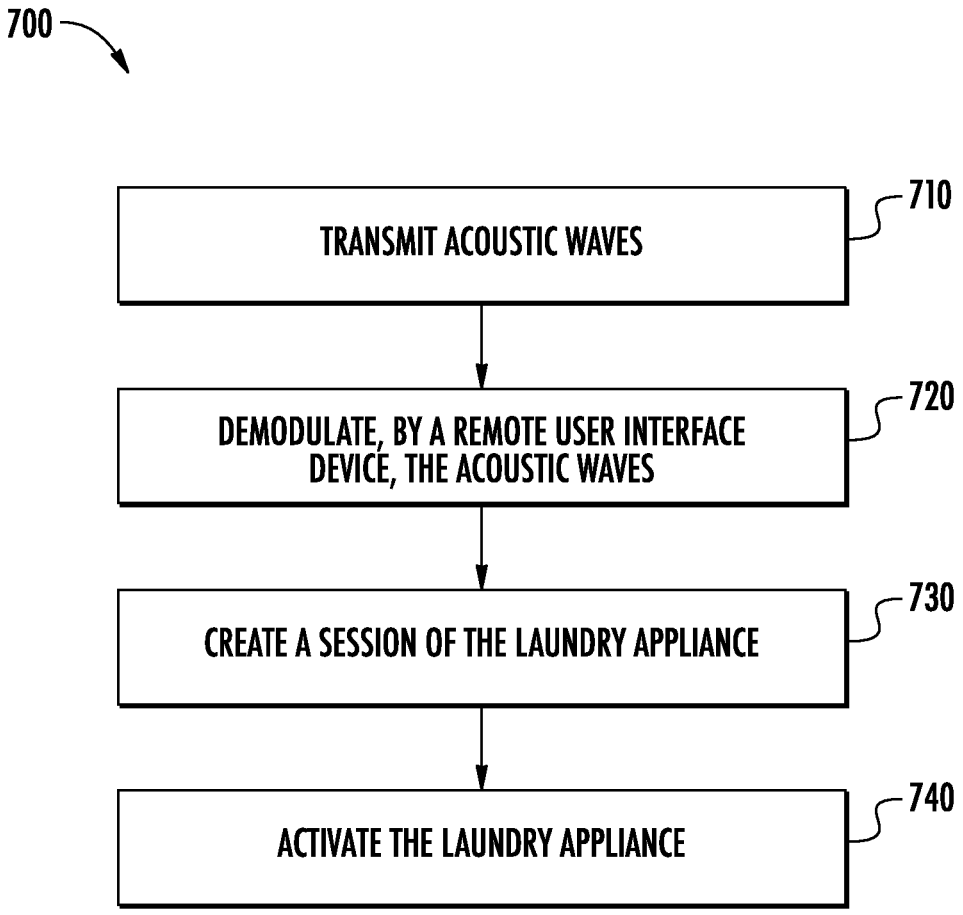
FIG. 10 provides a flowchart illustrating another example method of operating a laundry appliance according to one or more additional embodiments of the present disclosure.

As illustrated in FIGS. 9 and 10, embodiments of the present disclosure include methods of operating a laundry appliance, such as the exemplary laundry appliances 10 and 100 described above, as well as other possible exemplary laundry appliances. Exemplary methods according to the present subject matter include method 600 illustrated in FIG. 9 and method 700 illustrated in FIG. 10. Controller 156 of laundry appliance 100 may be programmed to implement method 600 and/or method 700, e.g., controller 156 is capable of and may be operable to perform any methods and associated method steps as disclosed herein. In some embodiments, the controller 156 may perform method steps in combination with one or more remote computing devices, such as a remote database or remote processor or one or more other remote computing devices, e.g., in a distributed computing environment such as the cloud, the fog, and/or the edge. Thus, references herein to a "remote computing device" include at least one such device with which a laundry appliance and/or remote user interface device communicates, e.g., over the internet, such as one or more remote computing devices in the cloud, etc. In such embodiments, the controller 156 may communicate with such remote computing device or devices via the internet, among other possible communications means. For example, some embodiments of the methods disclosed herein may include distributed computing whereby certain steps or calculations/determinations are performed locally, e.g., by the controller 156 onboard the laundry appliance 100, while other steps or calculations/determinations are performed by a remote computing device with which the controller 156 communicates, e.g., via the internet.

As illustrated in FIG. 9, the method 600 may include a step 610 of locking the laundry appliance. Locking the laundry appliance may include locking a user interface of the laundry appliance, such as a remote and/or local controls of the laundry appliance. For example, the user interface may be locked, e.g., disabled, in that user input devices may be deactivated or otherwise placed in a non-responsive state to prevent activating of the laundry appliance. When the laundry appliance is locked, such as when the user interface of the laundry appliance is locked, user inputs, e.g., on the control panel 150 of the laundry appliance and/or on the display 1002 of the remote user interface device 1000 (e.g., where display 1002 comprises a touchscreen) are disabled whereby the laundry appliance, such as mechanical components thereof (e.g., one or more pumps, and/or motors, etc.) will not be activated in response to inputs or manipulation (e.g., button pressing or tapping on the touchscreen) of the user input devices or user interface.

Method 600 may further include a step 620 of projecting, by the laundry appliance, acoustic waves. In some embodiments, a speaker, e.g., speaker 190, may project the acoustic waves. As briefly mentioned above, the acoustic waves projected may be modulated to carry an indicium of the laundry appliance. In some embodiments, the acoustic waves may be projected in response to receiving an input command on the laundry appliance. More particularly, a prospective user of the appliance may indicate a desire to use the appliance, e.g., within a commercial setting such as a laundromat, by interacting with the appliance, e.g., physically. The input command may require a direct interaction between the user and the appliance. For instance, the input command may include an input interaction by the user. The input, such as an input button, contact switch, dial or knob, may be provided on a control panel, e.g., control panel 150 of the laundry appliance.

In some embodiments, the input command may place the laundry appliance in an active state. For example, in response to the receiving the input command, the laundry appliance may be placed in an active state that allows for a user to pair a remote user interface device, such as a smartphone, with the laundry appliance. As will be described in more detail below, the pairing of laundry appliance and the remote user interface device may unlock the laundry appliance. Thus, allowing a user to interact with the laundry appliance, e.g., via the remote user interface device, and perform operation cycles of the laundry appliance.

Further, in some embodiments, a user notification may be provided in response to the laundry appliance being placed in the active state. The user notification may be provided on the remote user interface device and may include, for example, a prompt to position the remote user interface device, e.g., smartphone, proximate to a speaker of the laundry appliance, such as speaker 190 described above. It should be appreciated that "proximate" as used herein refers to positioning the remote user interface such that it is close enough to the laundry appliance, and more particularly, the speaker of the laundry appliance, to receive the acoustic waves projected by the laundry appliance. As such, positioning the remote user interface device proximate to the laundry appliance may correspond to positioning the remote user interface device any suitable distance away from the laundry appliance that allows the remote user interface device to receive the acoustic waves that may be projected by the laundry appliance. Further, positioning the remote user interface device proximate to the laundry appliance may also correspond to positioning the remote user interface device within a distance from the laundry appliance which permits the remote user interface device to receive the acoustic waves with sufficient signal strength and/or clarity for the remote user interface device to decode, demodulate, or otherwise interpret the received acoustic waves.

Thus, in some embodiments, the method may further include step 630 of receiving, by a remote user interface device, the acoustic waves. In some instances, a microphone of the remote user interface device may receive the acoustic waves. Further, after receiving the acoustic waves, e.g., via a microphone of the remote user interface device, the acoustic waves may be demodulated to extract the indicium of the laundry appliance. For example, in some instances, demodulating the acoustic waves may include extracting an indicium from the acoustic wave that identifies the laundry appliance, such as a serial number or MAC ID of the laundry appliance.

As such, method 600 also includes step 640 of creating a session of the laundry appliance in response to the acoustic waves being received by the remote user interface device. More particularly, step 640 may be in response to the acoustic waves being demodulated as described in step 630. The extraction of the indicium from the acoustic waves may allow for the creation of the session of the laundry appliance. In some embodiments, creating a session may include pairing the laundry appliance and the remote user interface device, such that a session specific to the user of the remote user interface device may be created. For instance, a user profile and/or user account may be stored on the remote user interface device or otherwise accessible via the remote user device, e.g., within a mobile app, such as via the cloud. The user profile may include particular laundry settings such as a user's preferred or frequently used settings, e.g., laundry load size, water temperature, agitation power, spin speeds, detergent amounts, etc., for performing the laundry operation. The user account may include billing and/or payment information, e.g., which may be accessed to pay for the rental of the laundry appliance and/or which may include an account balance.

In addition, pairing the laundry appliance may include unlocking the laundry appliance. In some embodiments, unlocking the laundry appliance may include unlocking one or more user interfaces of the laundry appliance, such as a remote user interface, e.g., a smartphone app, and/or a local user interface such as control panel 150. For example, unlocking the user interface may include permitting the laundry appliance, e.g., the controller 156 thereof, to activate one or more mechanical components of the laundry appliance in response to a user input received at the user interface, e.g., at control panel 150 and/or from a user interface on the remote user interface device.

Method 600 may further include a step 650 of activating the laundry appliance after creating a session of the laundry appliance, and more particularly, after unlocking the laundry appliance. For example, when the user interface of the laundry appliance is unlocked, the laundry appliance, e.g., one or more mechanical components thereof, may be activated, such as turning on or activating a motor or a pump. For example, activating the laundry appliance may include performing an operating cycle of the laundry appliance, such as the exemplary operating cycle described above.

Referring now specifically to FIG. 10, a method 700 of operating a laundry appliance is illustrated in accordance with exemplary aspects of the present disclosure. In some embodiments, the method 700 may include a step 710 of transmitting acoustic waves that are modulated to carry an indicium of the laundry appliance. Transmitting acoustic waves may include projecting, by the laundry appliances, the acoustic waves such as described above. More particularly, a speaker, such as speaker 190 of the laundry appliance, may project the acoustic waves. In addition, in some embodiments, method 700 may include receiving the projected acoustic waves, such as by a remote user interface device. More particularly, a microphone of the remote user interface device may receive the projected acoustic waves.

Moreover, in some embodiments, the method 700 may further include receiving an input command, such as described above, on the laundry appliance that places the laundry appliance in an active state. In some instances, the laundry appliance may transmit the acoustic waves when the laundry appliance is in the active state. In addition, a user notification may be provided, on the remote user interface device, in response to the laundry appliance being placed in the active state. The user notification may include a prompt to position the remote user interface device proximate to the laundry appliance, and more particularly, a speaker of the laundry appliance.

Method 700 may also include a step 720 of demodulating the acoustic waves. The demodulation of the acoustic waves may be performed by the remote user interface device. In addition, the demodulation of the acoustic waves may extract the indicium carried by the acoustic waves, such as described above. In addition, the method 700 may further include a step 730 of creating a session of a laundry appliance. In some embodiments, creating a session of the laundry appliance comprises pairing the laundry appliance and the remote user interface device such that a session specific to the user of the remote user interface device may be created. It should be appreciated that the session specific to the user may allow the user to operate the laundry appliance while keeping the laundry appliance locked to other users. As such, the session specific to the user may allow only the user, e.g., the remote user interface device paired with the laundry appliance, to operate the laundry appliance during the duration of the session created.

In addition, pairing the laundry appliance may include unlocking the laundry appliance. In some embodiments, unlocking the laundry appliance may include unlocking one or more user interfaces of the laundry appliance, such as a remote user interface, e.g., a smartphone app, and/or a local user interface such as control panel 150. For example, unlocking the user interface may include permitting the laundry appliance, e.g., the controller 156 thereof, to activate one or more mechanical components of the laundry appliance in response to a user input received at the user interface, e.g., at control panel 150.

Method 700 may further include a step 740 of activating the laundry appliance after creating a session of the laundry appliance, and more particularly, after unlocking the laundry appliance. For example, when the user interface of the laundry appliance is unlocked, the laundry appliance, e.g., one or more mechanical components thereof, may be activated, such as turning on or activating a motor or a pump. For example, activating the laundry appliance may include performing an operating cycle of the laundry appliance, such as the exemplary operating cycle described above.

The several embodiments of the present disclosure provide numerous advantages. For example, but without limitation, the exemplary methods of unlocking a laundry appliance may promote easier and quicker pairing of a laundry appliance and a remote user interface device. As another example, the exemplary methods may provide a more reliable way to unlock a laundry appliance as identifying markers printed on laundry appliance and the drawbacks associated with them may be eliminated. Accordingly, by utilizing acoustic waves projected by the appliance, a laundry appliance may be unlocked quickly and reliably.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry appliance, the method comprising:

locking the laundry appliance;

receiving an input command on the laundry appliance after locking the laundry appliance;

projecting, by the laundry appliance, acoustic waves in response to receiving the input command on the laundry appliance, wherein projecting the acoustic waves comprises modulating the acoustic waves to carry an indicium of the laundry appliance;

receiving, by a remote user interface device, the acoustic waves, wherein receiving the acoustic waves comprises demodulating the acoustic waves to extract the indicium of the laundry appliance;

creating a session of the laundry appliance, wherein creating the session comprises pairing the laundry appliance and the remote user interface device based on the indicium of the laundry appliance, and wherein pairing the laundry appliance comprises unlocking the laundry appliance; and activating the laundry appliance via the remote user interface device after creating the session of the laundry appliance.

2. The method of claim 1, wherein a speaker of the laundry appliance projects the acoustic waves.

3. The method of claim 1, wherein a microphone of the remote user interface device receives the acoustic waves.

4. The method of claim 1, wherein activating the laundry appliance comprises performing an operating cycle of the laundry appliance.

5. The method of claim 1, wherein the input command places the laundry appliance in an active state, wherein the active state allows the laundry appliance to pair with the remote user interface device.

6. The method of claim 5, wherein the laundry appliance projects the acoustic waves when the laundry appliance is in the active state.

7. The method of claim 5, further comprising providing a user notification, on the remote user interface device, in response to the laundry appliance being placed in the active state.

8. The method of claim 7, wherein the user notification comprises a prompt to position the remote user interface device proximate to a speaker of the laundry appliance.

9. A method of operating a laundry appliance, the method comprising:

transmitting acoustic waves in response to an input command on the laundry appliance, wherein transmitting the acoustic waves comprises modulating the acoustic waves to carry an indicium of the laundry appliance;

demodulating, by a remote user interface device, the acoustic waves to extract the indicium of the laundry appliance;

creating a session of the laundry appliance, wherein creating the session comprises pairing the laundry appliance and the remote user interface device based on the indicium of the laundry appliance, and wherein pairing the laundry appliance comprises unlocking the laundry appliance; and activating the laundry appliance via the remote user interface device after creating the session of the laundry appliance.

10. The method of claim 9, wherein transmitting acoustic waves comprises projecting, by the laundry appliance, the acoustic waves.

11. The method of claim 10, wherein a speaker of the laundry appliance projects the acoustic waves.

12. The method of claim 9, wherein transmitting the acoustic waves comprises receiving, by the remote user interface device, the acoustic waves.

13. The method of claim 12, wherein a microphone of the remote user interface device receives the acoustic waves.

14. The method of claim 9, wherein the input command places the laundry appliance in an active state, wherein the active state allows the laundry appliance to pair with the remote user interface device.

15. The method of claim 14, wherein the laundry appliance transmits the acoustic waves when the laundry appliance is in the active state.

16. The method of claim 14, further comprising providing a user notification, on the remote user interface device, in response to the laundry appliance being placed in the active state.

17. The method of claim 16, wherein the user notification comprises a prompt to position the remote user interface device proximate to the laundry appliance.

* * * * *